US005240673A

United States Patent [19]

Tiwari et al.

[11] Patent Number: 5,240,673

[45] Date of Patent: Aug. 31, 1993

[54] PROCESS FOR DEALUMINIZING MOLTEN CAST IRON

[75] Inventors: Basant L. Tiwari, Sterling Heights; Seymour Katz, West Bloomfield, both of Mich.

[73] Assignee: General Motors Corporation, Detroit, Mich.

[21] Appl. No.: 941,287

[22] Filed: Sep. 4, 1992

[51] Int. Cl.[5] ..... B28B 7/34; C21C 7/00

[52] U.S. Cl. ..... 420/33; 75/303; 75/305; 75/309

[58] Field of Search ..... 420/33; 75/303, 305, 75/309

[56] References Cited

U.S. PATENT DOCUMENTS 3,446,614 5/1969 Johnson ..... 420/33

4,102,690 7/1978 Koper ..... 75/305

*Primary Examiner*—Peter D. Rosenberg

*Attorney, Agent, or Firm*—Lawrence B. Plant

[57] ABSTRACT

Recontaminating cast iron by contacting it with a molten flux consisting essentially of silicon dioxide and calcium fluoride.

4 Claims, 1 Drawing Sheet

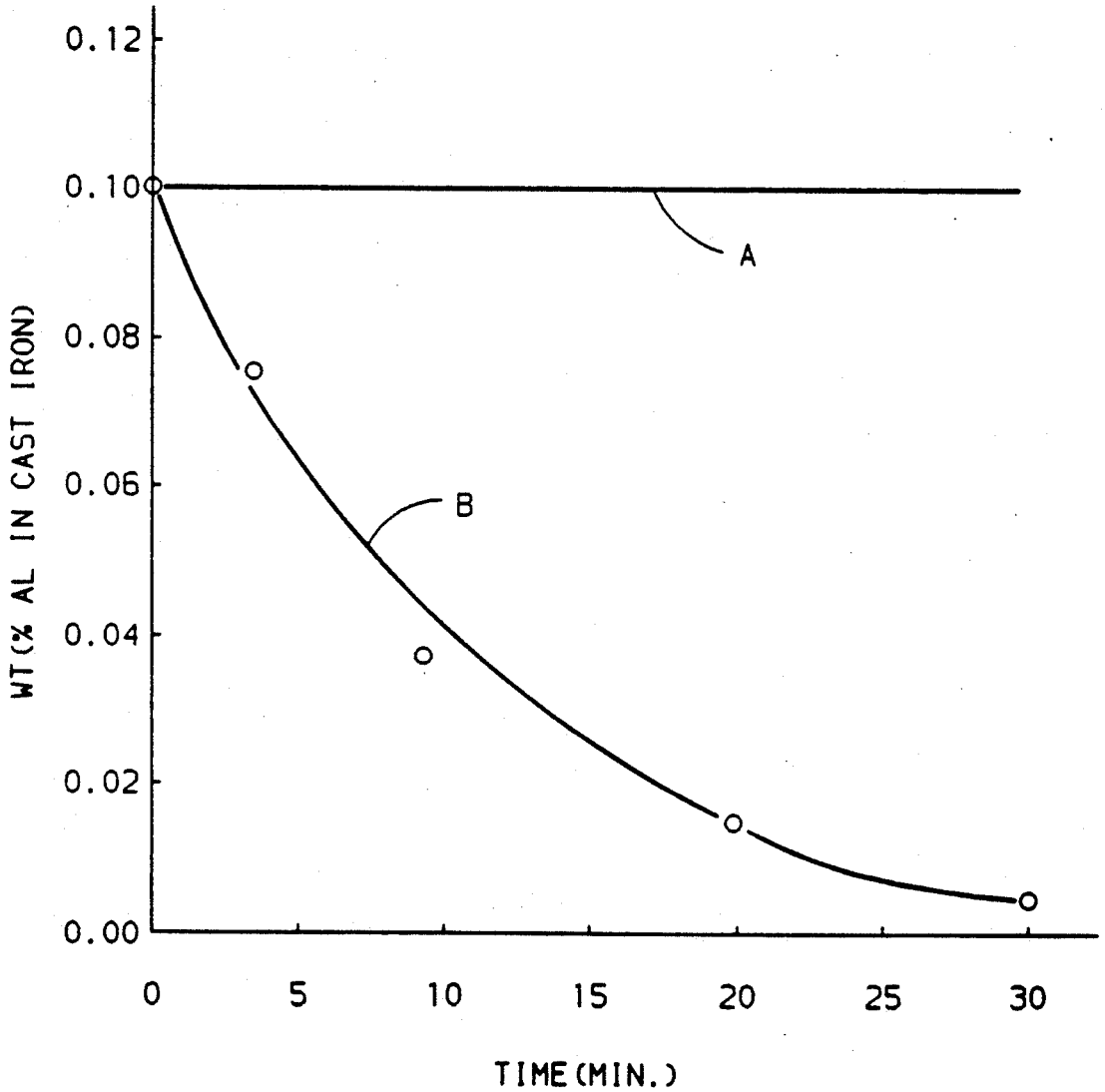
0.12
0.10
0.08
0.06
0.04
0.02
0.00
WT(% AL IN CAST IRON)
A
B
0
5
10
15
20
25
30
TIME(MIN.)

PROCESS FOR DEALUMINIZING MOLTEN CAST IRON

This invention relates to a process for removing aluminum from molten cast iron, and more particularly to the use of a molten $SiO_2$-based flux which consumes the aluminum while enriching the cast iron with silicon.

BACKGROUND OF THE INVENTION

Automobile scrap is used in many foundries as a source of iron for cast iron. With the increasing use of aluminum in automobiles, the aluminum level in the automobile scrap is significantly higher than in years past. Moreover, it has been found that the addition of aluminum to a coupla charge may reduce coke consumption and silicon loss as well as increase the melt temperature and reduce the sulfur content of the molten cast iron produced therefrom This iron contains higher then normal and deleterious amounts of aluminum. Regardless of the source of aluminum, the aluminum level in molten cast iron may easily reach a level where harmful effects are experienced. For example, the literature indicates that aluminum concentrations greater than 0.01% by weight may cause pinholes in the castings In addition to the pinholes, the presence of aluminum causes excess dross formation due to continuous oxidation of aluminum to aluminum oxide which all too often becomes entrapped in the melt which, in turn, introduces inclusions in the castings. Moreover, excess dross formation creates metal handling problems and increases the metal loss.

Heretofore, attempts have been made to oxidize the aluminum by bubbling air and/or oxygen through the melt or by using a high velocity lance positioned above the melt surface and projecting the oxygen/air onto the surface. Moreover, solid reagents such as iron ore, ferric oxide, sodium sulfate, or manganese oxide have also been used to oxidize the aluminum. Unfortunately, such oxidizing agents also react with any carbon and silicon present in the melt and thereby reduce their concentrations. The sodium sulfate additionally contaminates the melt with sulfur and produces sodium vapor. Chlorine and molten manganese chloride flux have also been reported as candidates for removing aluminum without affecting the silicon and carbon content of the melt. Chlorine unfortunately produces a considerable amount of iron chloride fume which causes a pollution problem. Dolomitic limestone addition has also been proposed, but this results in oxidation of carbon, adsorption of heat from the melt incident to the decomposition of the carbonates, and formation of considerable MgO and CaO dust aggravated by the formation of $CO_2$ gas. Finally, manganese metal containing nitrogen has been proposed, but is ineffective to reduce the aluminum content to below 0.01%.

It would be desirable to develop a simple, inexpensive pollution-free process of dealuminizing molten cast iron without scavenging the carbon and/or silicon from the molten metal.

Accordingly, it is an object of the present invention to provide a process for dealuminizing molten cast iron which process utilizes a molten $SiO_2$-based flux which, upon mixing with the molten iron, oxidizes the aluminum and any other metallic contaminants therein susceptible to silica oxidation (e.g., cerium) and advantageously seeds the molten iron with silicon without substantially depleting the iron of carbon or other desirable ingredients. This and other objects and advantages of the present invention will become more readily apparent from the detailed description thereof which follows.

The FIG. shows comparison curves of $SiO_2$ and $SiO_2$-$CaF_2$ fluxes.

The present invention contemplates an dealuminization process for removing aluminum from molten cast iron, which process is simple, pollution-free, relatively quick, does not deplete the molten cast iron of its carbon and enriches the iron with silicon. While the invention is most particularly applicable to the removal of aluminum, other silica-oxidizable metals are also removed (e.g., certain Periodic Table Group IIIA, Group IVA and Group VA metals such as cerium) by the invention.

More specifically, the present invention contemplates a method for substantially dealuminizing aluminum-containing cast iron, wherein: the iron is heated to a temperature sufficient to keep it molten throughout the period of treatment; a molten flux is disposed atop the molten iron, which flux consists essentially of silicon dioxide and sufficient calcium fluoride to liquify a substantial proportion of the flux at the molten iron's temperature; stirring the molten iron and flux together in such a manner as to cause the liquified silicon dioxide therein to react with the aluminum (i.e., to form aluminum oxide) and release silicon into the melt. In this regard, stirring is very vigorous and such as to break the molten flux into small droplets (i.e., dropletize) for better reaction with the iron. The aluminum oxide formed by the reaction dissolves in the molten $SiO_2$-$CaF_2$ flux until saturation occurs, at which time it floats to the top of the melt where it can be skimmed off as dross. Treatment continues for a sufficient time for the aluminum content thereof to drop to an acceptable level which is preferably below about 0.01% by weight.

The flux consists essentially of silicon dioxide and about 35% or more $CaF_2$, and preferably about 55% to about 65% by weight $SiO_2$ and the balance calcium fluoride. At 1450° C., this results in a low viscosity mixture of a $SiO_2$-saturated liquid (i.e., ca. 80% weight) and $SiO_2$ solids (ca. 20%). Below about 35% $CaF_2$ the solids content of the flux increases and renders it so viscous and "gloppy" that it is practically impossible to dropletize sufficiently for effective reaction with the aluminum Higher amounts of $CaF_2$ yield a higher percentage of liquid and hence a less viscous, more easily dropletized and dispersed material. The $CaF_2$ content will vary with the temperature of the molten iron (i.e., typically between about 1400° -1500° C.) and such that a substantial proportion of the flux (i.e., at least about 80% by weight) thereof will be in a liquid state.

In addition to removing aluminum, the flux advantageously forms a solid $SiO_2$ atop the molten portion which helps reduce splashing of molten metal out of the reactor. As molten silica is consumed by the aluminum in the iron, it is continuously replenished from the solid silica such that the activity of the silica in the molten flux is maintained close to unity. The dealuminizing reaction is as follows:

$$3\ SiO_2 + 4\ Al \rightarrow 2\ Al_2O_3 + 3\ Si$$

The flux is floated on top of the iron and vigorously stirred into the iron so as to break up the flux into small droplets (i.e., dropletizing) for enhanced reaction with the aluminum. The molten iron is preferably stirred by bubbling nitrogen up from the bottom thereof through porous ceramic plugs which are placed in the floor of the reaction vessel. Other known stirring techniques capable of dropletizing the molten flux are also acceptable.

SPECIFIC EXAMPLE

In one test of the invention, 30 pounds of cast iron containing 0.1% aluminum was placed in a graphite crucible and melted in an induction furnace at a temperature of 1450° C. The melt was stirred by bubbling nitrogen through a tube which extended down to the bottom of the crucible The nitrogen emanating from the top of the melt blanketed the top of the crucible and provided an inert atmosphere over the top surface thereof preventing oxidation of the molten cast iron. A flux comprising 65 weight percent silicon dioxide and 35 weight percent calcium fluoride was added to the melt and, after melting, was broken up into small droplets and mixed with the iron by the stirring action of the nitrogen bubbles. Progress of the dealuminization reaction was monitored by analyzing for aluminum in samples taken at timed intervals. The identical test was made using solid silica particles alone (i.e., without $CaF_2$ present to liquify it). The results of these tests are shown in the FIG. wherein the $CaF_2$-containing flux is plotted as curve B and the $CaF_2$-free flux is plotted as curve A. The results show that solid silica does not react with a significant amount of the aluminum, whereas the molten silica reacts with substantially all of the aluminum as shown by curve B of FIG. 1 This is attributed in large part to the fact that solid aluminum oxide formed with the $CaF_2$-free flux tended to coat the solid $SiO_2$ particles and stifle further reaction therewith, whereas in the liquid $SiO_2$-$CaF_2$ flux the $Al_2O_3$ harmlessly dissolved in the flux without passivating the $SiO_2$ against further reaction.

While the invention has been disclosed primarily in terms of specific embodiments thereof it is not intended to be limited thereto, but rather only to the extent set forth hereafter in the claims which follow.

The embodiments of the invention in which an exclusive property or privilege is claimed are defined as follows:

1. A method for substantially dealuminizing molten cast iron containing a deleterious amount of aluminum, comprising the steps of heating the cast iron to a temperature sufficient to melt said iron, disposing a molten flux atop said iron said flux consisting essentially of silicon dioxide and sufficient calcium fluoride to liquify at least about 80% by weight of said flux at said temperature, and stirring said iron and said flux so as to dropletize said flux and cause the droplets to intimately mix with said iron such that said silicon dioxide reacts with said aluminum to form an oxide thereof and concurrently release silicon into said iron, dissolving said oxide in said molten flux, and continuing the foregoing process for a sufficient time to reduce the content of the aluminum in said iron to below said deleterious amount.

2. A method according to claim 1 wherein said deleterious amount is 0.01% or more by weight.

3. A method according to claim 1 wherein said flux consists essentially of about 55% to about 65% by weight $SiO_2$ and the balance essentially calcium fluoride.

4. A method according to claim 1 wherein said stirring is accomplished by bubbling inert gas upwardly through said molten iron.

* * * * *